US010946945B2

(12) United States Patent
Patterson

(10) Patent No.: US 10,946,945 B2
(45) Date of Patent: Mar. 16, 2021

(54) CUTTING DEVICE FOR PROPELLER DRIVEN WATERCRAFT

(71) Applicant: Robert Patterson, Church Road, VA (US)

(72) Inventor: Robert Patterson, Church Road, VA (US)

( * ) Notice: Subject to any disclaimer, the term of this patent is extended or adjusted under 35 U.S.C. 154(b) by 0 days.

(21) Appl. No.: 16/163,494

(22) Filed: Oct. 17, 2018

(65) Prior Publication Data

US 2019/0112016 A1 Apr. 18, 2019

Related U.S. Application Data

(60) Provisional application No. 62/573,585, filed on Oct. 17, 2017.

(51) Int. Cl.
*B63H 5/16* (2006.01)
*B63H 1/28* (2006.01)

(52) U.S. Cl.
CPC ..... *B63H 5/165* (2013.01)

(58) Field of Classification Search
CPC ..... B63H 5/16; B63H 5/165
USPC ..... 114/71–73; 416/134 R, 146 R
See application file for complete search history.

(56) References Cited

U.S. PATENT DOCUMENTS 726,180 A * 4/1903 Miller ..... B63H 5/165 440/73
732,568 A * 6/1903 Lee ..... B63H 5/165 440/73
1,390,397 A 9/1921 Svenson
4,080,099 A 3/1978 Snyder
4,447,215 A 5/1984 Govan
4,450,670 A 5/1984 Robinson
4,507,091 A * 3/1985 Govan ..... B63H 5/165 416/146 R
4,544,363 A * 10/1985 Govan ..... B63H 5/165 416/146 R
4,609,361 A 9/1986 Sumino
4,676,758 A 6/1987 Dennis
4,718,871 A * 1/1988 Mendelevitch ..... B63H 5/165 114/140
4,801,281 A * 1/1989 Govan ..... B63H 5/165 416/134 R
4,911,664 A 3/1990 Gremillion
4,943,249 A * 7/1990 Govan ..... B63H 5/165 416/146 R
4,954,108 A * 9/1990 Govan ..... B63H 5/165 416/146 R
5,807,150 A * 9/1998 Minter, Sr. ..... B63H 5/165 416/146 R
6,004,174 A * 12/1999 Govan ..... B63H 5/165 416/146 R
6,113,445 A 9/2000 Trosclair
6,478,639 B1 11/2002 Covell, III
(Continued)

*Primary Examiner* — Daniel V Venne
(74) *Attorney, Agent, or Firm* — Derrick Harvey; Harvey Law, PC

(57) ABSTRACT

A system for cutting marine grasses, weeds and other plant life to protect a propeller drive watercraft is disclosed. An adjustable, protective cutting edge to protect a propeller, drive shaft of a boat or other watercraft motor is further disclosed. A propeller protection device to mount upon a watercraft is further disclosed for optimizing the navigation of watercraft and reducing in-piloting maintenance of clearing plant matter from a propeller of a watercraft.

18 Claims, 12 Drawing Sheets

(56) References Cited

U.S. PATENT DOCUMENTS

| | | | | |
|---|---|---|---|---|
| 6,922,982 | B1 * | 8/2005 | Smith | A01D 44/00<br>440/73 |
| 7,273,402 | B2 * | 9/2007 | Mullings | B63H 5/165<br>416/146 R |
| 7,425,162 | B2 | 9/2008 | Caulfield | |
| 8,007,329 | B2 | 8/2011 | Wengren, Jr. | |
| 8,974,260 | B1 | 3/2015 | Davidson | |
| 9,296,454 | B1 | 3/2016 | Lucarelli | |

* cited by examiner

CUTTING DEVICE FOR PROPELLER DRIVEN WATERCRAFT

RELATED APPLICATIONS

This application claims priority from U.S. Provisional Application No. 62/573,585 filed on Oct. 17, 2017 and entitled "Cutting Device for Propeller Driven Watercraft," the entire contents of which are hereby fully incorporated herein.

BACKGROUND OF THE INVENTION

The invention comprises a system for cutting marine grasses, biomass and other plant life found in navigable waters. The invention further comprises an adjustable, protective blade to protect a propeller, drive shaft and a boat or other watercraft motor. The invention further comprises an expansive cutting device to mount upon a watercraft motor. The invention even further comprises a method for selecting a cutting profile near a propeller for navigating a watercraft through natural aquatic plant life or other impediments to operating a propeller in waters.

1. Field of the Invention

The present invention relates to propeller driven marine motors. The present invention even further relates to grass cutting surfaces for propeller blades. The present invention even further relates to solutions for navigating a marine propeller through waters that have grasses that could imperil the operation of the marine propeller, motor and thus the watercraft. The present invention even further relates to such cutting surfaces being adjustable to enable maximum cutting efficiency for variable environmental marine conditions.

2. Description of Related Art

When propeller driven watercraft are deployed across rivers, lakes, and oceans, they often must contend with a number of different grasses and other plant life that threaten to tangle up against itself, the propeller blade, and other watercraft structures. As a result, the operator of the watercraft is forced to turn off the motor and manually remove the plant matter from the propeller area. The related art discloses grass cutting devices attempting to solve similar problems with cutting plant life. For instance, see U.S. Pat. No. 9,296,454, and products known commercially as "The Shank," "The Weed Chopper," and "Shear Magic." Such prior art solutions are of insufficient dimension, material and structure to provide qualities sought by users of marine craft that utilize propeller propulsion. There remains a need for a grass cutting solution that is easily and manually applied to the propeller shaft. There further remains a need for grass cutting device that is adjustable for variability in marine grass types and density. There remains a need for a solution has a cutting surface capable of cutting different types and concentrations of plant matter. There remains even further a need for a solution that helps, rather than harms, the tracking and steering of the watercraft.

SUMMARY OF THE INVENTION

These and other objects were met with the present invention. In a first embodiment, the present invention comprises a base configured to affix to at least one of a motor housing and shaft of a watercraft, the base comprising a first base opening; a cutting implement, the cutting implement capable of detachably mating to the base, the cutting implement having a cutting side proximal to propeller blades of the watercraft; the cutting side having a cutting surface on at least a portion of a side of the cutting implement; the cutting implement comprising a fixation element that may secure the cutting implement to the base so that the cutting surface may be set at a preferred distance from the propeller blades, the cutting implement further comprising a first implement mating channel, whereas the fixation element may be disposed therethrough the first base opening and the first implement mating channel thereby securing the base and cutting implement together.

In a second embodiment of the invention, a propeller protection system comprises a base configured to affix to at least one of a motor housing and shaft of a watercraft; and a cutting implement capable of mating with the base, the cutting implement comprising a cutting surface having an adjustable relationship to the base, the cutting surface being configured to adjustably move towards propeller blades of a watercraft, the cutting implement further comprising a cutting edge located on at least a portion of the cutting implement; the cutting implement comprising a trailing portion opposite that of the propeller blade side of the cutting implement, the cutting implement further comprising an implement mating channel extending between the cutting edge and the trailing portion of the cutting implement, the mating channel having an arcuate path configured to allow adjustment of the cutting implement's proximity to the propeller blades and disposition upon the base.

BRIEF DESCRIPTION OF THE DRAWINGS

The invention will now be described in greater detail with reference to the drawings.

DETAILED DESCRIPTION OF THE INVENTION

Figure 1:
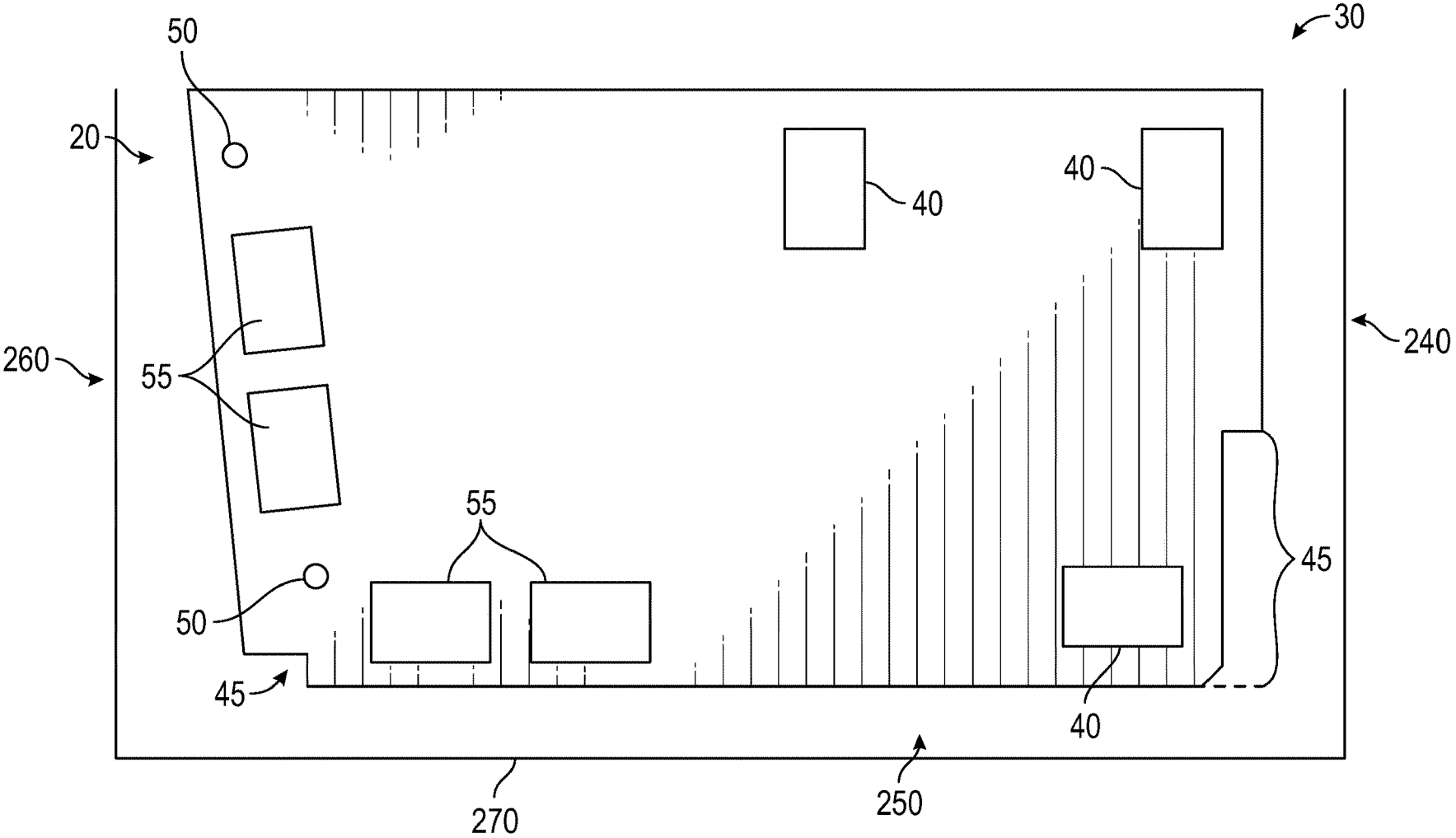
FIG. 1 depicts a side view of the base in an embodiment of the inventive device.
Figure 2:
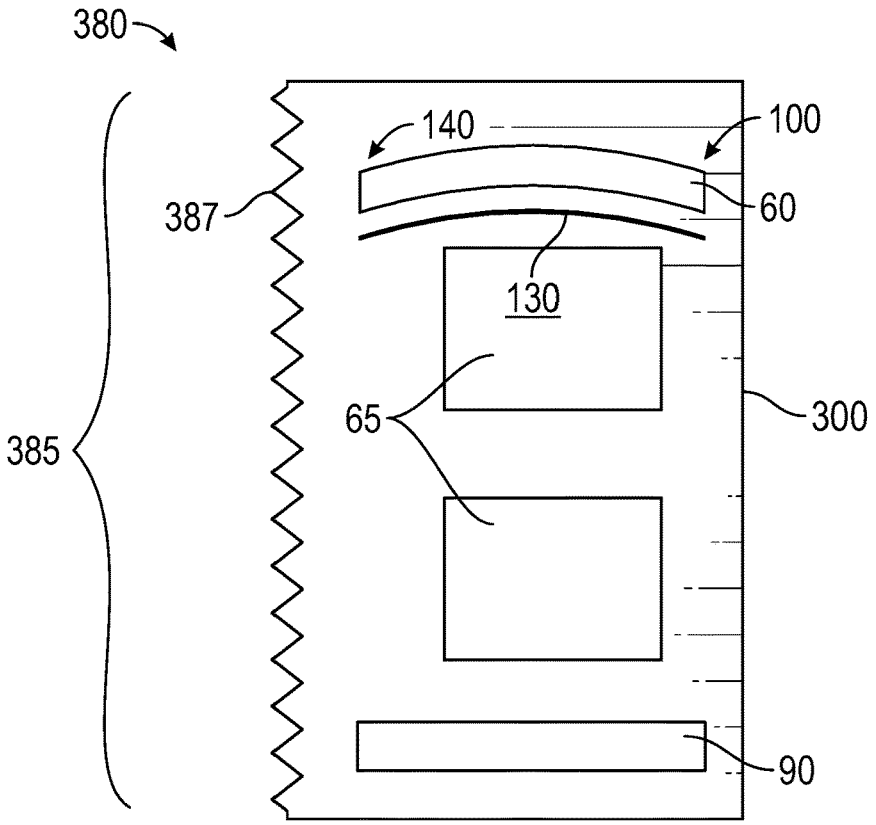
FIG. 2 depicts a first side view of the base in an embodiment of the inventive device.
Figure 3:
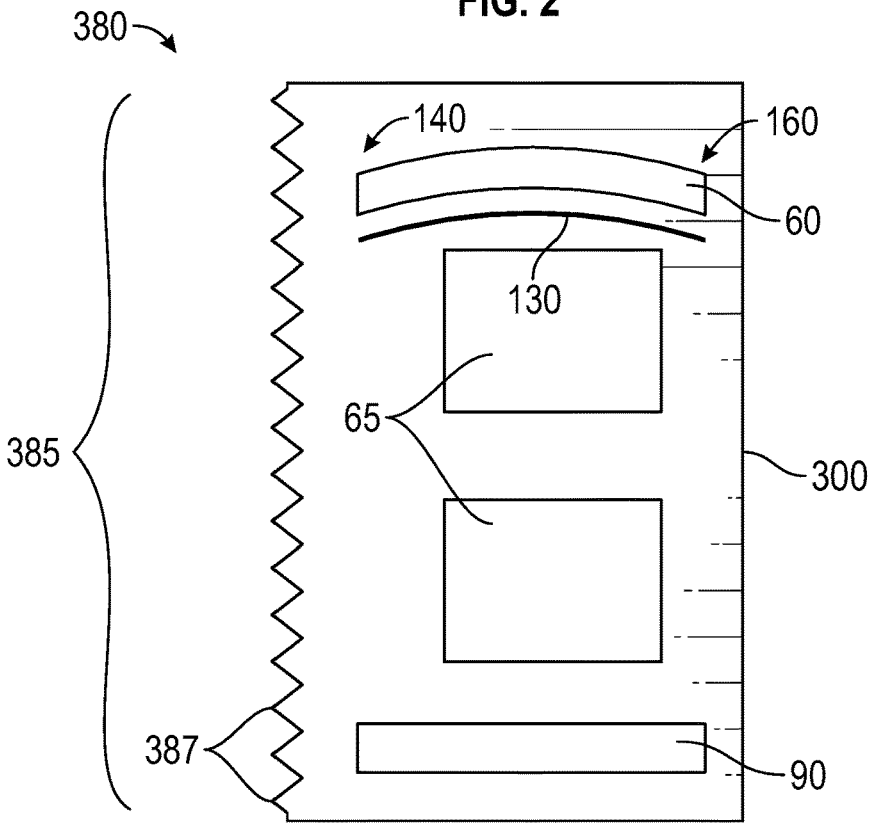
FIG. 3 depicts a second side view of the base in an embodiment of the inventive device.

The present invention provides a device that resolves a number of shortcomings reflected in the prior art, resulting in a solution that user-friendly and environmentally superior. First, the invention addresses the needs of the prior art with a device that has multiple cutting and shear points to address different types and densities of plant matter, and further solves this challenge by presenting an adjustable cutting surface. Second, the present solves issues in the prior by preventing the plant matter from becoming entangled with other plant matter. Third, the present inventor even further resolves issues in the prior art by improving tracking and steering of the propelling motor by removing impediments to the propeller operating as intended.

Looking at the FIGS. 1-20, an embodiment of a plant matter cutting device is depicted as having a base 30 securing upon a motor housing 190 and shaft. The base may connect to the motor housing 190 of a watercraft. The embodiment of the base shown in the FIGS. 1 and 8-17 may have a flat profile, having a shaft side 240, a motor body side 250, and a propeller blade side 260. Other embodiments of the base well within the scope of the invention may have additional sides. Still other embodiments not depicted may include different structural profiles, including those with curved surfaces, with additional volumes (those having 3 dimensions beyond rectangular), and other profiles that are capable of carrying out the purposes of the present invention.

The base 30 of cutting implement may include a first base opening 50, a second base opening 50, and additional base openings extending between a first face 33 and a second face 36. The first base openings and second base opening 50 and/or the first base window and second base windows 55 may be defined by interior portions of the base 30 in the embodiment of the base, and are illustrated in FIGS. 1 and 8-17 as having generally rectangular or square profiles, though with rounded corners or even circular profiles in some embodiments of the first base opening 50 and second base opening 50. In other embodiments of the invention, base openings may include curved portions such as circular profiles, linear portions such as n-gon profiles, or having both curved or and linear aspects such as hemisphere profiles. In other embodiments of the base not shown, the one or more base openings 50 may be least partially open a side of the base such as the motor body side 250 or a shaft side 240, or in embodiments of the base 30 having curved exterior portions at the said curved exterior portion. Other irregular aspects of the base 30 may be within the scope of the invention, as shown in an embodiment of the invention in FIG. 1 that shows at least one corner of the base with a cut-out 45 from the overall shape of the base 30. Sides of the base further may form acute or obtuse angles with adjacent sides of the base in embodiments not shown in the illustrations, so that regular and irregular geometric configurations are within the scope of the invention. In an unexpected benefit of the invention, the bases 30 shown as embodied in FIGS. 1, 9 and 20 have a shaft side 240, motor housing side 250, and propeller blade side 260 that form a perimeter 270 extending between the propeller blades 170 and the shaft 200 of the motor assembly 340, which have exhibited the effect of obstructing plant life by spreading out and thus separating grasses and other plant matter so that they are either cut by the cutting implement or shielded from tangling with fellow grasses and plant matter. In other embodiments, the perimeter may resemble other geometric profiles.

Figure 4:
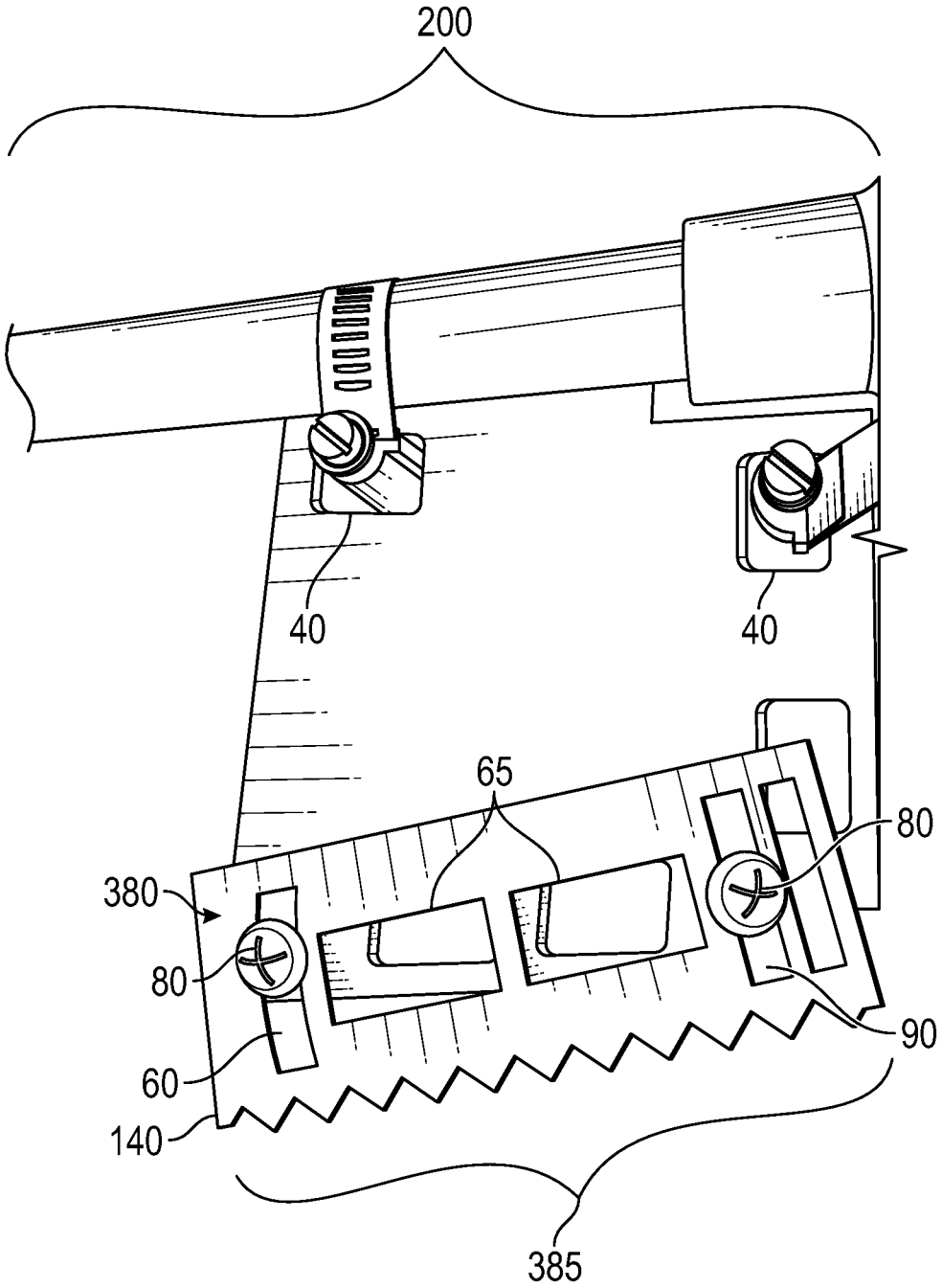
FIG. 4 illustrates a side perspective profile of the inventive system, with the cutting implement affixed to the base mounted on the propeller shaft.
Figure 5:
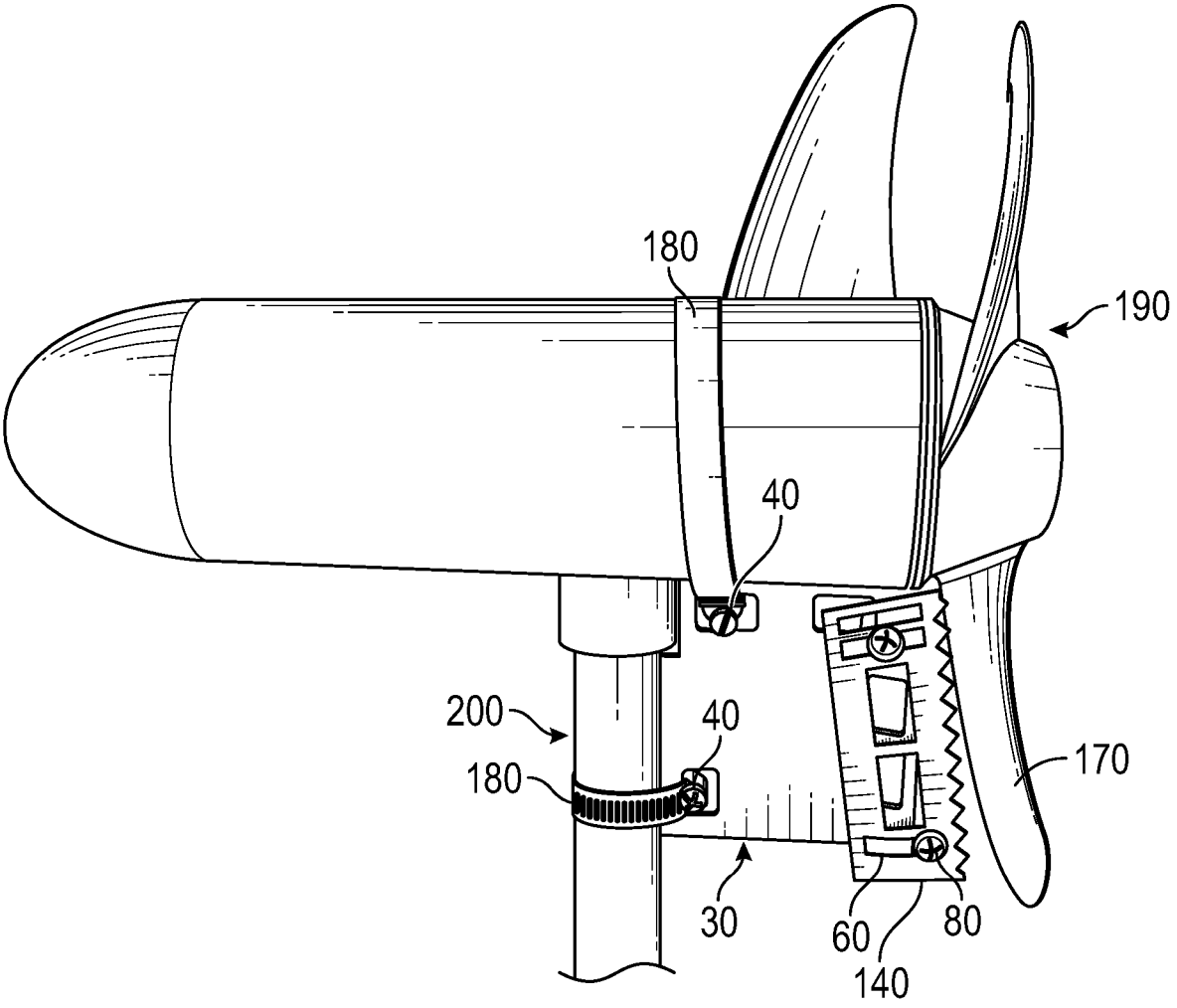
FIG. 5 illustrates a side profile of an embodiment of the inventive system, with the cutting implement affixed to the base mounted on the propeller shaft and propeller body.
Figure 6:
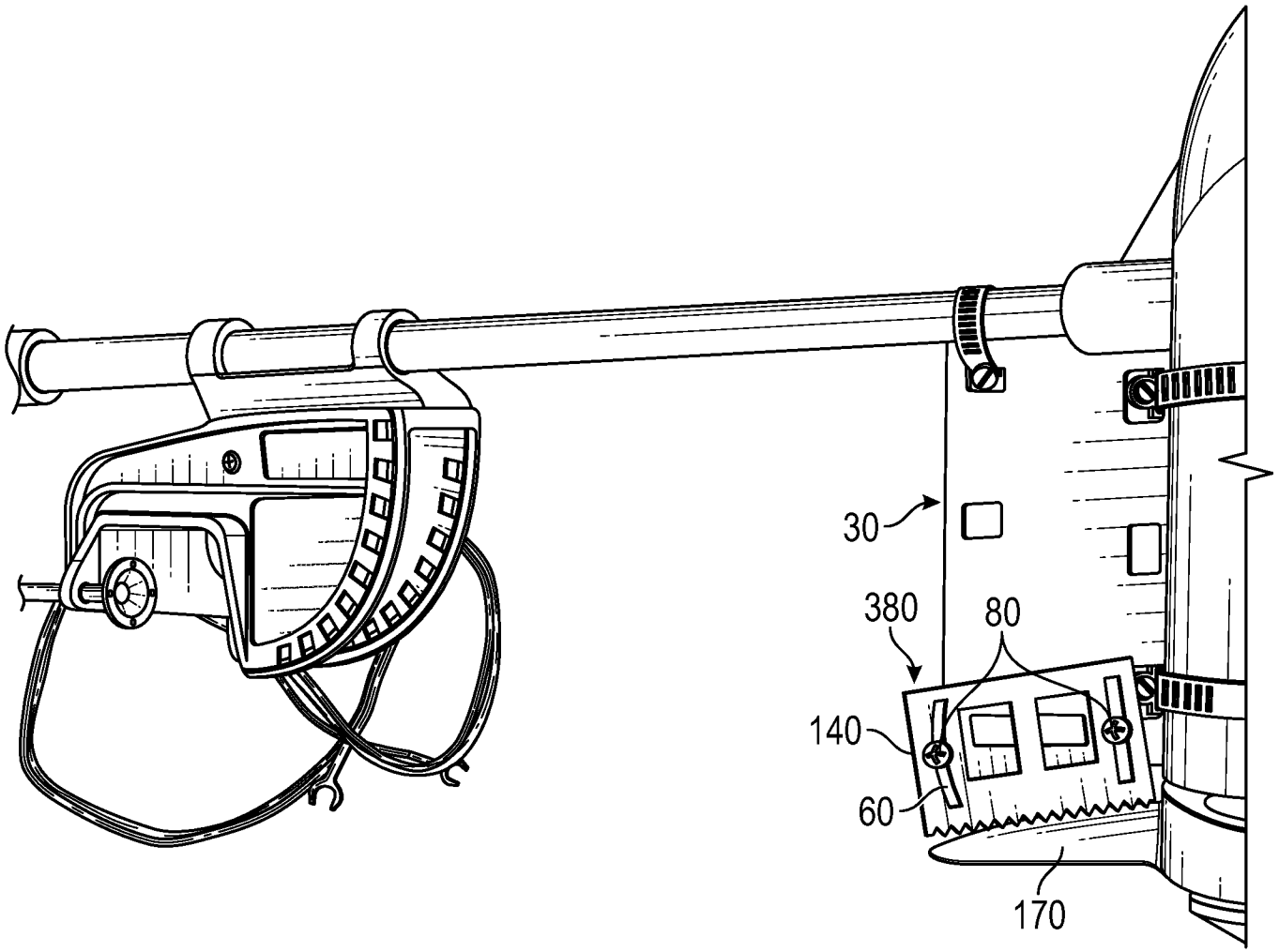
FIG. 6 illustrates a side perspective profile of an embodiment of the inventive system, with the cutting implement affixed to the base mounted on the propeller shaft and propeller body.
Figure 7:
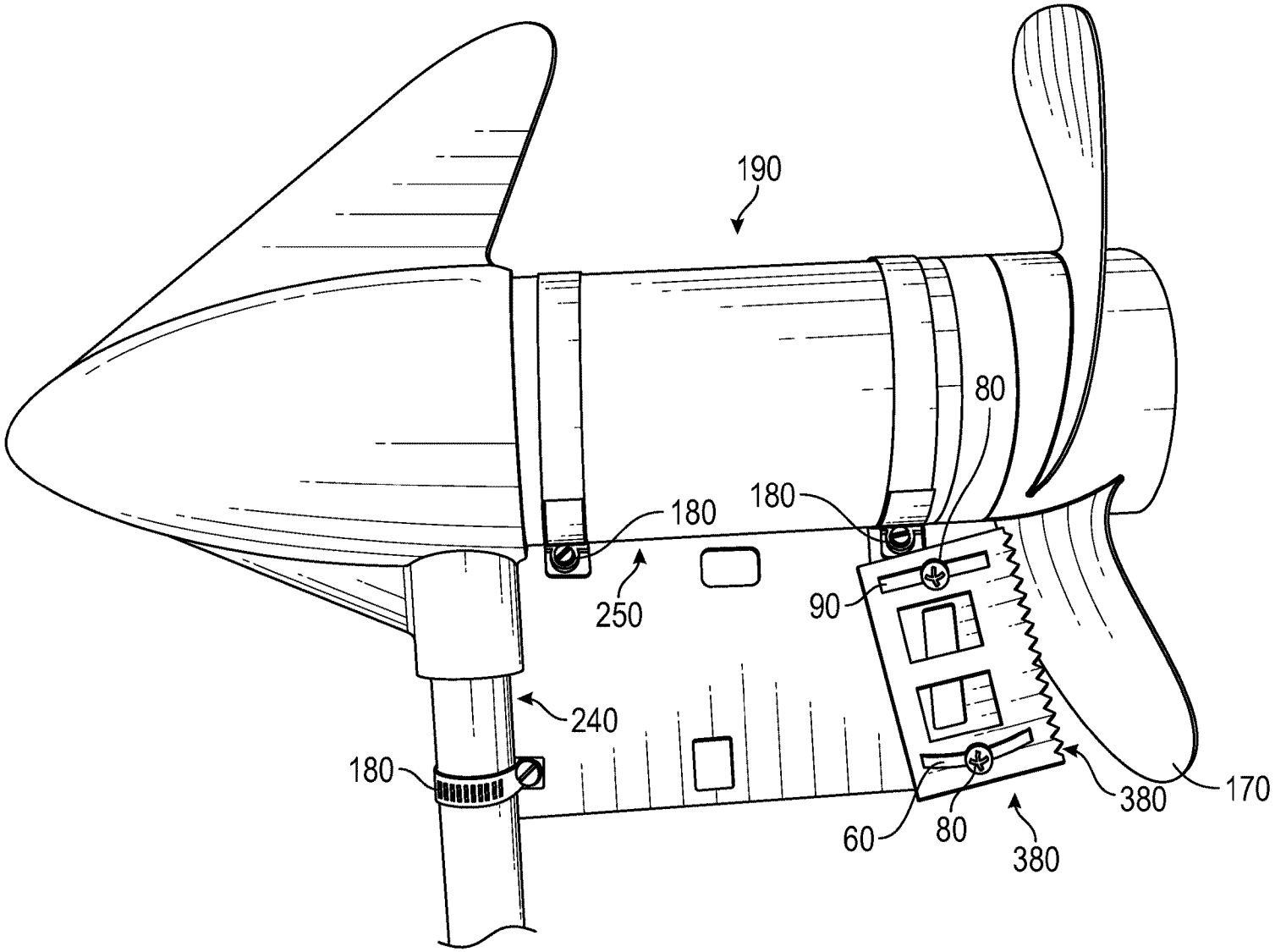
FIG. 7 illustrates a side perspective profile of an embodiment of the inventive system, with the cutting implement affixed to the base mounted on the propeller shaft and propeller body.
Figure 8:
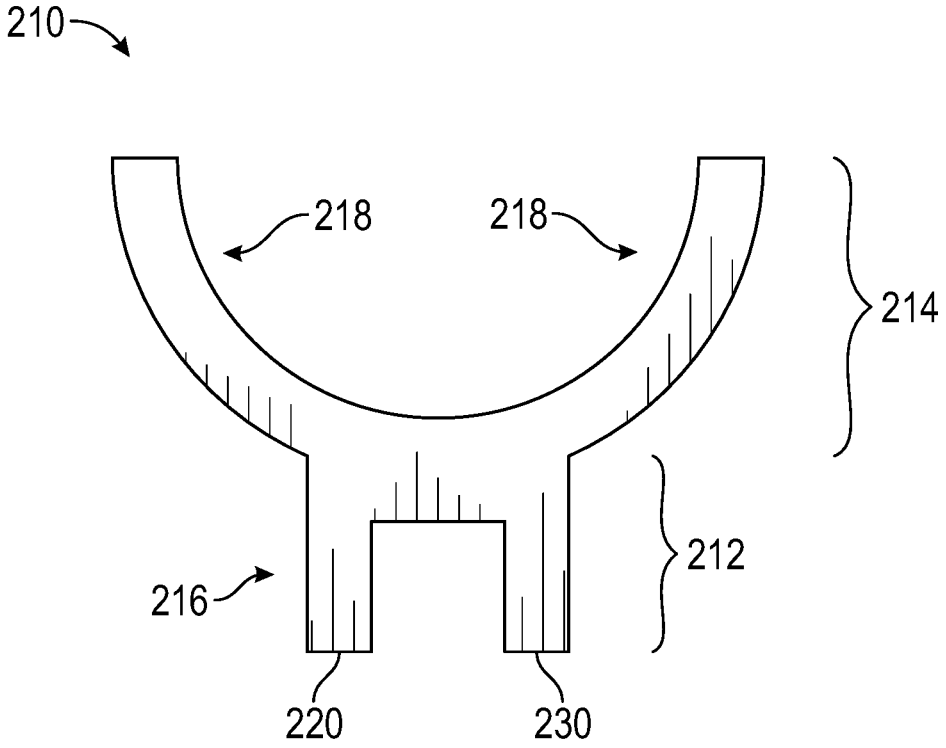
FIG. 8 illustrates a top plan view of a clip that may affix the propeller protection device to a shaft of a watercraft motor assembly.
Figure 11:
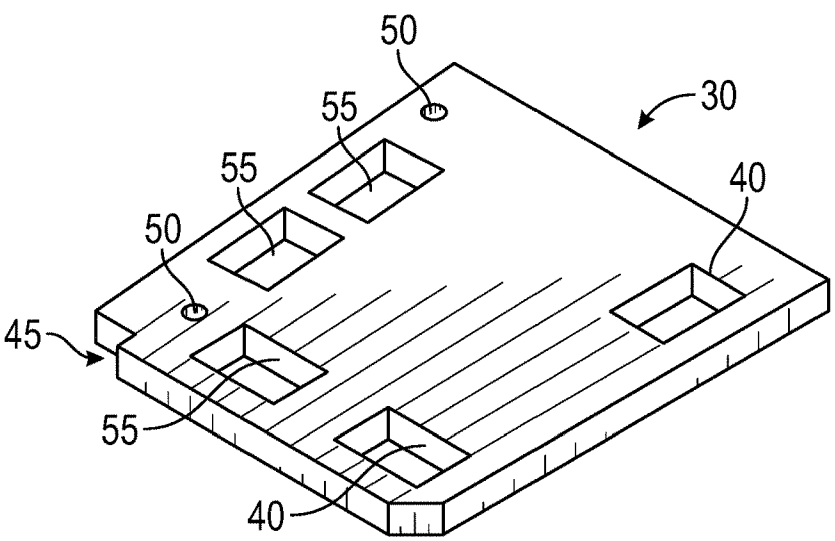
FIG. 11 depicts a side perspective view of the second embodiment of the base.
Figure 10:
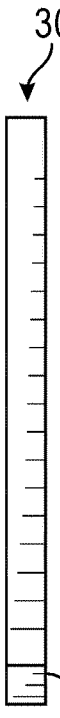
FIG. 10 depicts a side profile view of the second embodiment of the base.
Figure 9:
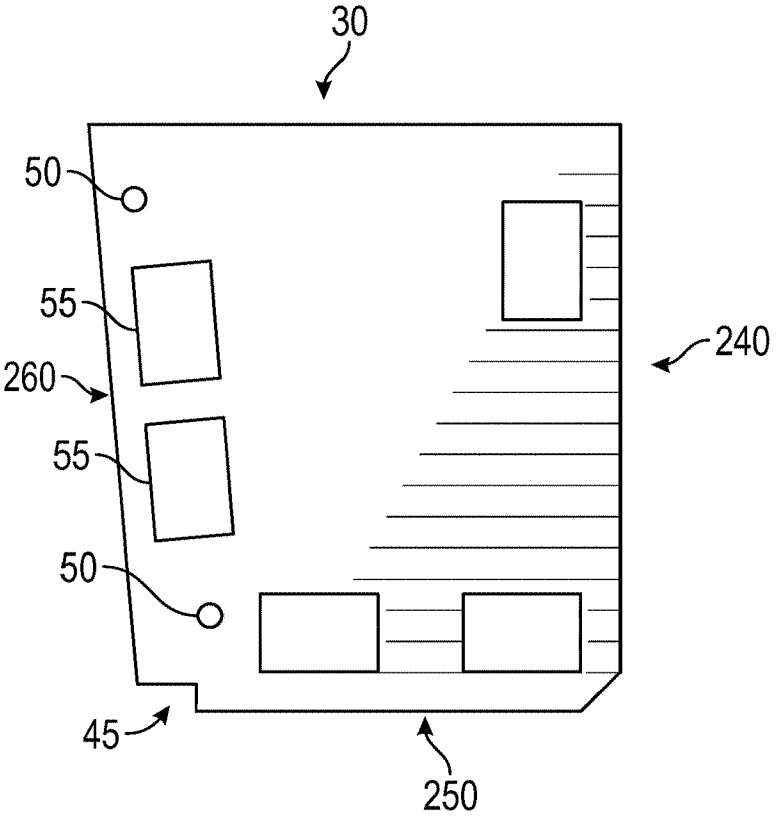
FIG. 9 depicts a side view of the second embodiment of the base.
Figure 14:
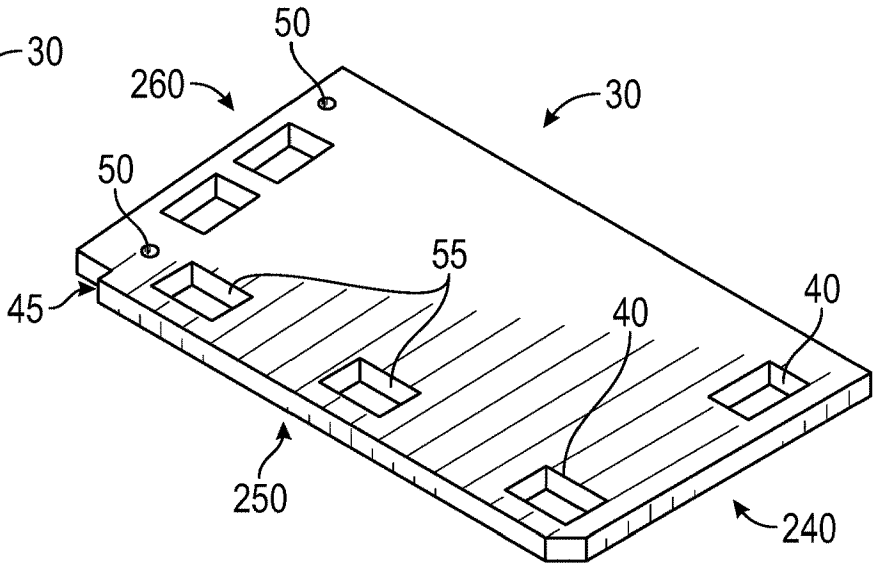
FIG. 14 depicts a side perspective view of the third embodiment of the base.
Figure 13:
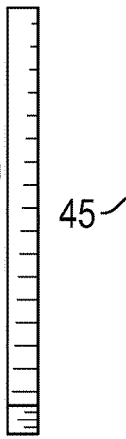
FIG. 13 depicts a side profile view of the third embodiment of the base.
Figure 12:
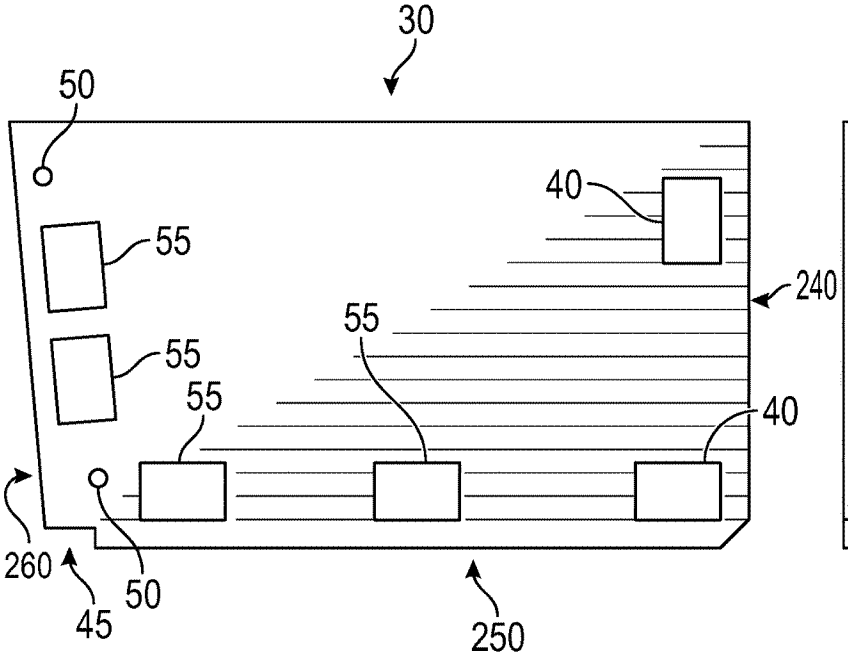
FIG. 12 depicts a side view of the third embodiment of the base.
Figure 17:
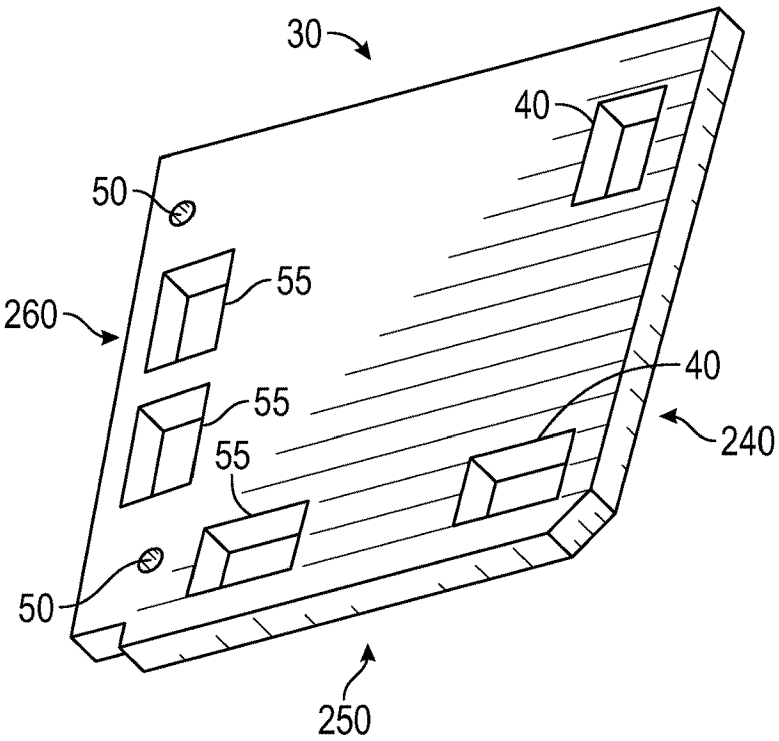
FIG. 17 depicts a side perspective view of the fourth embodiment of the base.
Figure 16:
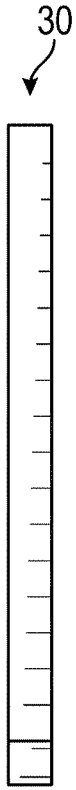
FIG. 16 depicts a side profile view of the fourth embodiment of the base.
Figure 15:
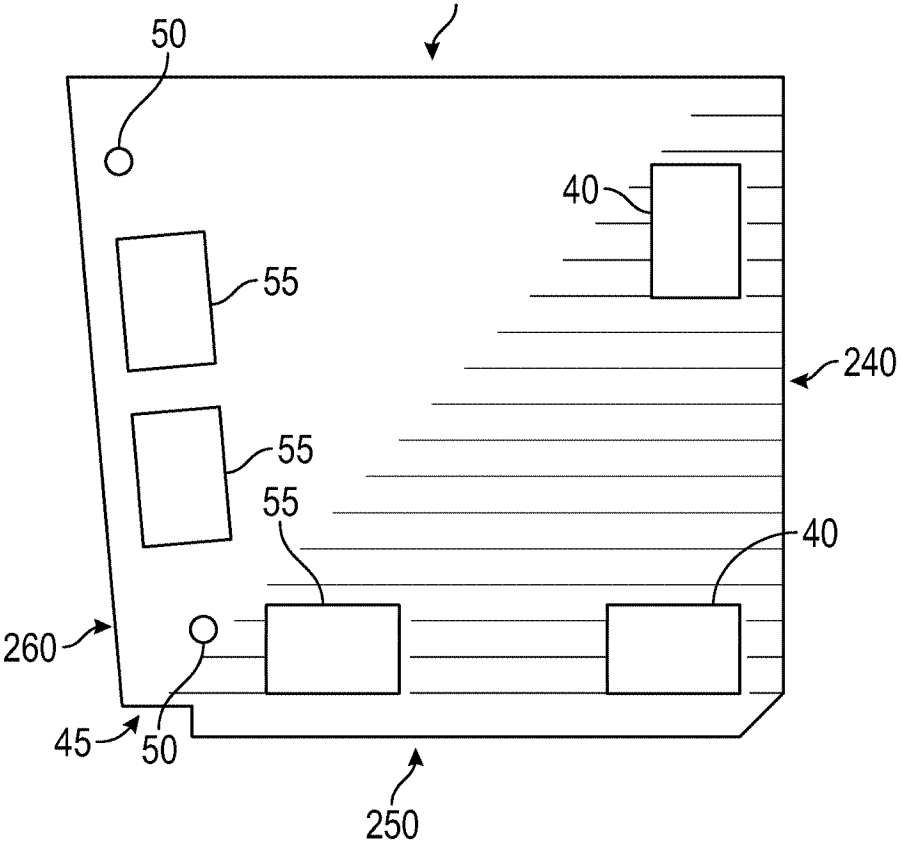
FIG. 15 depicts a side view of the fourth embodiment of the base.
Figure 19:
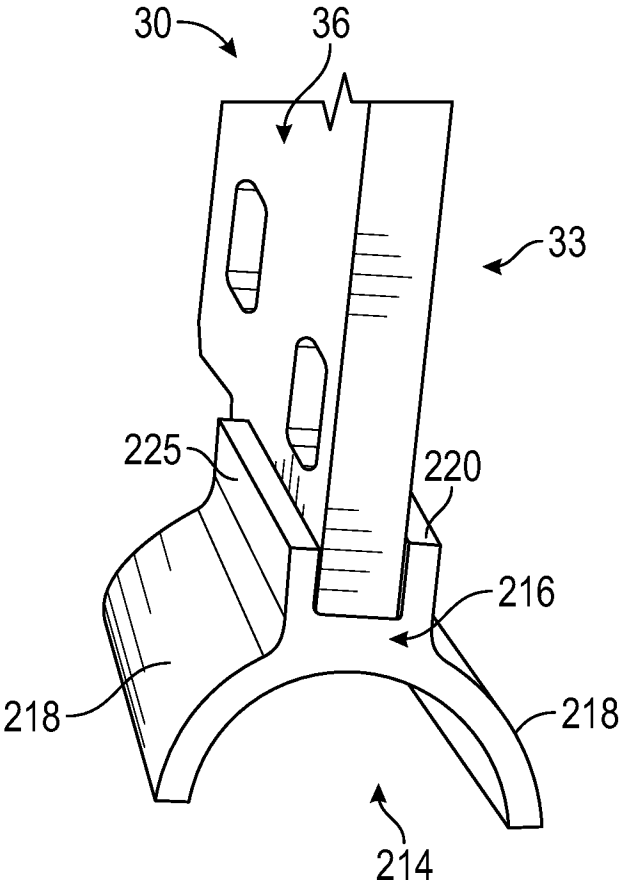
FIG. 19 illustrates an axial perspective view of the clip affixed to a base of the propeller protection device.
Figure 18:
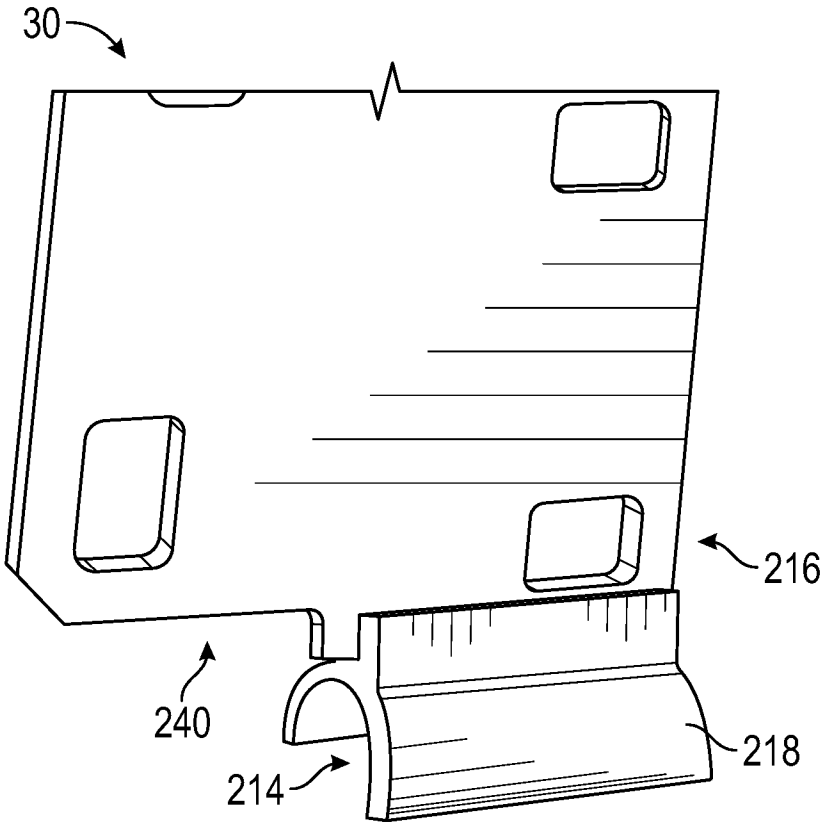
FIG. 18 illustrates a side lower perspective view of a clip affixed to a base of the propeller protection device.
Figure 20:
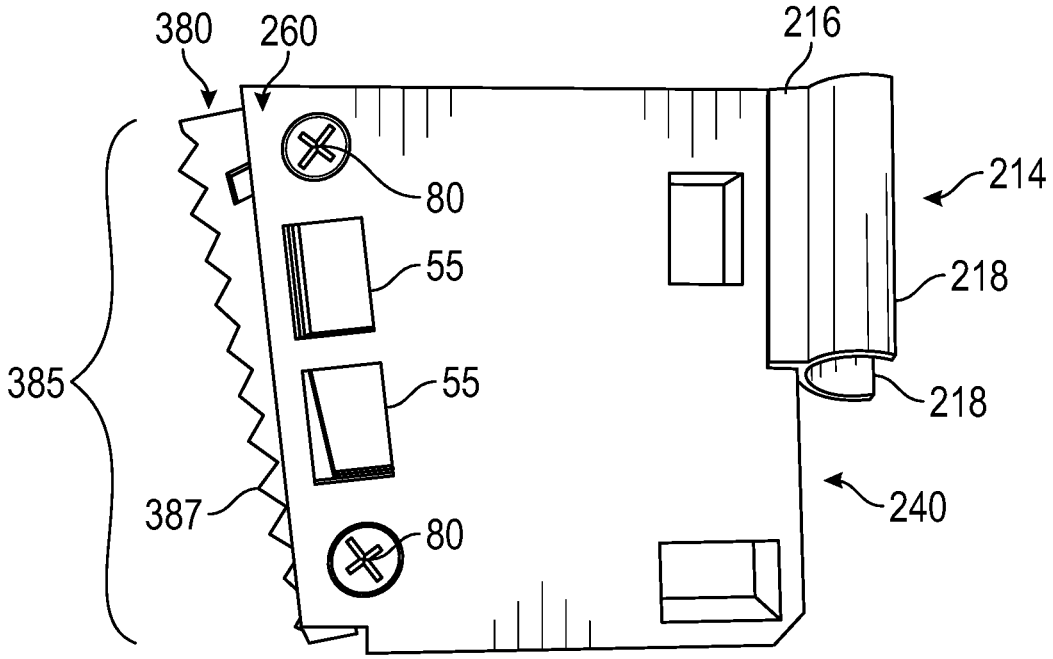
FIG. 20 illustrates a side perspective view of the clip affixed to a base along with the propeller protection device.

The embodiment of the base as shown in FIGS. 4-7 may affix to the shaft side 240 of the base and the motor body side 250 of the base using affixing tools. An example of an affixing tool may be found in FIG. 4, shown as at least one screw retained hose clamps 180 through the at least one or more base openings 50, or one or more base fixation openings 40. Other means of affixation of the base to the motor shaft may be well within the scope of the present invention, including structures known in the arts to mate two similar bodies directly and indirectly. In another embodiment not illustrated, the base may mate to the shaft and motor body without use of openings or mating structures by way of welding, gluing or other binding. In still another embodiment of the invention, a clip 210 such as one illustrated in FIGS. 8 and 18-20 may detachably affix to both the shaft 200 and the base 30, according to embodiments of the invention. Clip 210 may have a base portion 212 and a shaft portion 214. As illustrated in FIG. 20, a base portion 212 of the clip 210 may comprise a bracketing element 216 that affixes by friction fit to the shaft side 240 of the base to engage with the first 33 and second 36 face of the base 30. Base element 216 of the base portion 212 of the clip 210 shown as having a first 220 and second 230 base arm extending towards the base 30. In other embodiments, the base element 216 may have at least one base arm. Similarly, the clip 210 may attach at its shaft side 240 of the clip 210 with a shaft element 218 or elements extending toward the shaft 200, shown in FIGS. 18-20 as being parabolic in profile. In an embodiment not shown, clip 210 may attach to the motor housing using at least one motor element(s) that extend toward the motor body side 250 of the base within the scope described herein.

Looking further at the illustrations of the inventive device, a base may support a cutting implement or cutting surface. Cutting implement 380 may be positioned co-planar and adjacent to base 30 of the device. In the embodiment shown in FIGS. 2, 3 and 4, cutting implement 380 many include implement windows 65 that may line up fully or partially, with base windows 55 on the propeller side 260 of the base 30, so that at least one base window 55 of the base at least partially overlaps with the at least one implement window 65 of the cutting implement 380. Cutting implement 380 may include a first implement mating channel 60 having an arcuate span 130 with a first end 140 and a second end 160, the second end 160 correlating to a trailing portion 300 of the cutting implement 380. Cutting implement 380 may further comprise a second implement mating channel 90, shown in FIGS. 2 and 3 to be positioned further to the perimeter 270 of the base than the implement openings 65. According to the embodiment in the FIGS. 4-7 and 20, mating channels 60 and 90 may screw-retained via a fixation element, shown as first fixation element 80 and second fixation element 80 through the base fixation opening 50, and secured with lock washers. In other embodiments, bolts, pins, rods and other tools known in the industry to join one or more surfaces may be utilized within the scope of the invention. In still other embodiments, base and cutting implement may be mated together using a male-female pin relationship, gear cogs, or through other mating solutions understood in the arts.

A seen in FIGS. 4-7 and 20, first implement mating channel 60 and second implement mating channel 90 may enable the first and second fixation elements 80 to fix the cutting implement 380 onto the base in a preferred orientation. The first implement mating channel 60 or arcuate span 130 may resemble an arcuate opening as seen in FIGS. 4-7 and 20, enabling a more circumferential positioning cutting implement 380 vis a vis the base 30. Arcuate span 130 may comprise a first end 140 correlating to the cutting surface and a second end 160 correlating towards a trailing portion of the cutting implement, so that the cutting implement 380 generally at the first end 140 may travel an arcuate path between the propeller blades and the cutting edge 385 or cutting surface 387, enabling the cutting surface 387 or edge 385 of the cutting implement 380 to be adjustably positioned in a substantially parallel and proximal relationship with the propeller blades 170. Other topographical features, base configurations and implement adjustment openings outside of the measurements shown in the illustrations may be within the scope of the invention, including regular patterns or matrices and those with irregular properties.

Looking further at the FIGS. 2-7 and 20, the cutting implement 380 may have a cutting side 385 or edge, the cutting side 385 having an x number of teeth, according to different embodiments of the invention, preferably in the 3-500 range, and in another embodiment in the 10-20 range. According to other embodiments not depicted, cutting side 385 may have a cutting surface 387 deployed only partially along the cutting side 385 of the cutting implement 380. Furthermore, the cutting surface may have cutting features other than teeth as depicted. Finer structures, such as a more serrated edge are well-within the scope of the invention, as are irregular cutting structures. Cutting surface may have other profiles than the linear one depicted in FIGS. 2-7, such as curved, angled, linear or combinations thereof.

In use, the user may deploy the cutting implement according to the marine conditions, the make of the watercraft motor assembly and environmental factors of the type of plant life found in the waters. Using an embodiment of the invention, the base may be secured generally flush to the shaft and motor housing using the affixing tools such as hose clamps or the affixing clip. The cutting implement may then be positioned according to the rotation of the propeller blade, so the blade does not impinge upon the cutting implement. The propeller blade may be bent towards the cutting element to discern the possible impingements during heavy use or other environment factors that may move the propeller blade from its normal rotation. The propeller blade at its most outwardly bent position may be used to move the cutting implement distally of the blade to a non-impinging position vis a vis the cutting edge of the cutting implement. In an embodiment of the invention, the second affixation element is tightened initially after clearing a second end of the cutting implement from the rotating propeller blade, then bending a tip of the propeller blade towards and pushing the first end of the cutting implement (the end correlating to the first cutting element) clear of any impingement from the tip of the propeller blade. In this configuration shown in FIG. 5, the cutting element is closer to being perpendicular to the propeller blade than to the propeller shaft. A method of positioning the propeller blade to a cutting surface may be within the scope of the present invention using the foregoing steps described.

While the present invention has been described in conjunction with the specific embodiments set forth above, many alternatives, modifications and other variations thereof will be apparent to those of ordinary skill in the art. All such alternatives, modifications and variations are intended to fall within the spirit and scope of the present invention.

The invention claimed is:

1. A propeller protection device comprising:

a base configured to affix to at least one of a motor housing and shaft of a watercraft, the base comprising a first base opening; and a cutting implement, the cutting implement capable of detachably mating to the base, the cutting implement having a cutting side proximal to propeller blades of the watercraft; the cutting side having a cutting surface on at least a portion of a side of the cutting implement; the cutting implement comprising a fixation element that may secure the cutting implement to the base so that the cutting surface may be set at a preferred distance from the propeller blades, the cutting implement further comprising a first implement mating channel, whereas the fixation element may be disposed therethrough the first base opening and the first implement mating channel thereby securing the base and cutting implement together.

2. The propeller protection device in claim 1, the first implement mating channel having a span that the fixation element may travel, the span positioned generally between the cutting surface of the cutting implement and a side opposite the cutting surface of the implement.

3. The propeller protection device in claim 2, the cutting implement having a second implement mating channel and the base comprising a second base opening, the propeller protection device further comprising a second fixation element, so that the second fixation element may connect the second implement mating channel and the second base opening, whereby the cutting implement may be disposed offset of the base.

4. The second implement mating channel of claim 3 being configured as an arcuate span extending towards the cutting surface on a first end, and towards a trailing portion of the cutting surface on a second end, so that the first end may be moved in a parabolic path proximal to the propeller blades.

5. The propeller protection device in claim 1 further comprising at least one hose clamp, whereas the at least one hose clamp may be threaded through a base fixation opening and connected to one of the motor housing or the shaft.

6. The propeller protection device in claim 1 further comprising a clip, the clip having at least one base element extending from the clip towards the base of the propeller protection device, and further having at least one shaft element extending from the clip towards shaft, whereas the at least one base element of the clip may detachably affix to the base of the propeller protection device and the at least one shaft element is configured to detachably affix to the shaft.

7. The propeller protection device in claim 6, whereas the perimeter of the base comprises a generally rectangular shape.

8. The propeller protection device in claim 1, the base further comprising a shaft side, a motor housing side, and a propeller blade side, the shaft side and motor housing side and the propeller blade side forming a perimeter when the base is affixed to the watercraft; whereas the perimeter as mated to the cutting implement obstructs grasses and other aquatic plantlife from wrapping around the shaft or the propeller blades.

9. The propeller protection device in claim 1 further comprising a clip, the clip having at least one base element extending from the clip towards the base of the propeller protection device, and further having at least one motor element extending from the clip towards the motor housing, whereas the at least one base element of the clip may detachably affix to the base of the propeller protection device and the at least one motor element is configured to detachably affix to the motor housing.

10. The propeller protection system in claim 1, the base having base window, the cutting implement having an implement window, whereby the base window at least partially overlaps with the implement window of the cutting implement.

11. A propeller protection system, the system comprising:

a base configured to affix to at least one of a motor housing and shaft of a watercraft; and a cutting implement capable of mating with the base, the cutting implement comprising a cutting surface having an adjustable relationship to the base, the cutting surface being configured to adjustably move towards propeller blades of a watercraft, the cutting implement further comprising a cutting edge located on at least a portion of the cutting implement; the cutting implement comprising a trailing portion opposite that of the propeller blade side of the cutting implement, the cutting implement further comprising an implement mating channel extending between the cutting edge and the trailing portion of the cutting implement, the mating channel having an arcuate path configured to allow adjustment of the cutting implement's proximity to the propeller blades and disposition upon the base.

12. The propeller protection system in claim 11 further comprising base opening configured to fix with the implement mating channel so that a fixation element may connect the base and cutting implement.

13. The propeller protection system in claim 11, the implement mating channel of the cutting implement having a first end and a second end, the first end correlating to the cutting surface and the second end correlating to the trailing portion.

14. The propeller protection system in claim 13, the cutting implement having a second implement mating channel and the base comprising a second base opening, the propeller protection device further comprising a second fixation element, so that the second fixation element may connect the second implement mating channel and the second base opening, whereby the cutting implement may be disposed offset of the base.

15. The propeller protection system in claim 14, the base having a base window, the cutting implement having an implement window, whereby the base window at least partially overlaps with the implement window of the cutting implement.

16. The propeller protection system in claim 14 further comprising at least one hose clamp.

17. The propeller protection system in claim 11 further comprising a clip to affix the base to the at least one of a motor housing and shaft of a watercraft.

18. The propeller protection device in claim 11, the clip further comprising at least one base element extending from the clip towards the base of the propeller protection device, and further having at least one shaft element extending from the clip towards shaft, whereas the at least one base element of the clip may detachably affix to the base of the propeller protection device and the at least one shaft element is configured to detachably affix to the shaft.

* * * * *